US006901713B2

(12) United States Patent
Axsom

(10) Patent No.: US 6,901,713 B2
(45) Date of Patent: Jun. 7, 2005

(54) MULTIPURPOSE COMPOSITE WALLBOARD PANEL

(76) Inventor: Erich Jason Axsom, 2940 Cliff Dr., Newport Beach, CA (US) 92663

( * ) Notice: Subject to any disclaimer, the term of this patent is extended or adjusted under 35 U.S.C. 154(b) by 0 days.

(21) Appl. No.: 10/307,192

(22) Filed: Nov. 29, 2002

(65) Prior Publication Data

US 2004/0103610 A1 Jun. 3, 2004

Related U.S. Application Data

(60) Provisional application No. 60/402,622, filed on Aug. 12, 2002, and provisional application No. 60/344,388, filed on Jan. 3, 2002.

(51) Int. Cl.[7] ..... E04C 2/34; E04C 1/00

(52) U.S. Cl. ..... 52/481.1; 52/309.9; 52/309.17; 52/396.04; 52/408

(58) Field of Search ..... 52/481.1

(56) References Cited

U.S. PATENT DOCUMENTS 4,077,168 A * 3/1978 Smith ..... 52/481.1
4,277,926 A * 7/1981 Sherman et al. ..... 52/302.3
4,458,462 A * 7/1984 Schold ..... 52/241
5,148,645 A * 9/1992 Lehnert et al. ..... 52/443
5,220,760 A * 6/1993 Dimakis ..... 52/309.9
5,220,762 A * 6/1993 Lehnert et al. ..... 52/408
5,319,900 A * 6/1994 Lehnert et al. ..... 52/408
5,345,738 A * 9/1994 Dimakis ..... 52/309.9
5,371,989 A * 12/1994 Lehnert et al. ..... 52/309.17
5,611,181 A * 3/1997 Shreiner et al. ..... 52/396.04
5,628,158 A * 5/1997 Porter ..... 52/309.9
5,644,880 A * 7/1997 Lehnert et al. ..... 52/408
5,666,775 A * 9/1997 Shreiner et al. ..... 52/396.04
5,704,179 A * 1/1998 Lehnert et al. ..... 52/408
5,729,936 A * 3/1998 Maxwell ..... 52/220.2
5,768,841 A 6/1998 Swartz et al.
5,791,109 A * 8/1998 Lehnert et al. ..... 52/309.17
5,966,885 A * 10/1999 Chatelain ..... 52/309.4
6,029,418 A * 2/2000 Wright ..... 52/745.1
6,125,608 A * 10/2000 Charlson ..... 52/733.2
6,298,612 B1 * 10/2001 Adams ..... 52/167.3
2003/0126817 A1 * 7/2003 Gleeson et al. ..... 52/460
2003/0131550 A1 * 7/2003 Cole et al. ..... 52/396.04
2003/0136072 A1 * 7/2003 Peng ..... 52/459
2004/0006948 A1 * 1/2004 Nahas ..... 52/749.12

* cited by examiner

*Primary Examiner*—Rodney B. White

(57) ABSTRACT

A multipurpose composite wallboard panel is disclosed as having an aluminum sheet (14) attached by means of an adhesive (16) to a wallboard panel (12), such as a gypsum wallboard panel. Such a composite panel can readily be handled and quickly attached to the framework of buildings for the purpose of bracing, finishing, fireproofing, and thermally insulating wall structures in a single wall sheathing procedure.

16 Claims, 5 Drawing Sheets

12'
22
28
12'
24
26
14
24
26
14
12
16
20
22
28
12
16

12'
22
28
12'
14
14
12
16
20
22
28
12
16

12'
22
28
12'
24
24
16
16
26
12
12
14
20
40
42
22
14

16
12
22
28
16
12
14
14
24
24
26
26
14
14
12
12
16
20
22
28
16

12'
22
28
12'
14
12'
20
22
28
12
16

12'
22
28
16
12
14
14
12'
20
22
28
12
16

MULTIPURPOSE COMPOSITE WALLBOARD PANEL

CROSS-REFERENCE TO RELATED APPLICATION

This application claims the benefit of Provisional Patent Application Ser. No. 60/402,622 filed 2002 Aug. 12 which is a continuation of Provisional Patent Application Ser. No. 60/344,388 filed 2002 Jan. 3.

FEDERALLY SPONSORED RESEARCH

Not Applicable

SEQUENCE LISTING OR PROGRAM

Not Applicable

BACKGROUND

1. Field of the Invention

The invention relates to buildings and, more particularly, to an improved wallboard panel for use in framed residential and commercial buildings.

2. Description of Prior Art

Since the time of the Industrial Revolution, framed building structures have a played a vital role in fulfilling the housing needs of an expanding U.S. population. It was in the 1830's that the first "Balloon Framed" structure was developed. Coupled with the means to mass produce nails, this new form of framing enabled builders to construct a home far more rapidly and for less money than the previous method of building which was referred to as "Post & Beam" or "Post-Frame" construction. A short time later, around the 1850's, "Balloon Framing" evolved into "Platform Framing." And to this day, well over a century later, the platform framing method is still employed as the best means for constructing homes in terms of both time and money savings.

Bracing these new light framed structures for stability was recognized as an essential element necessary for the safety of the occupants. Transient horizontal forces acting on these structures like those generated by wind and earthquakes were dealt with in much the same way until the 1960's. That is, between the 1830's and late 1950's, both the balloon framed structures as well as the platform framed structures (hereinafter referred to as "light framed structures") were braced with 1×6 sheathing boards fastened with two nails to each stud. Later, around the 1960's, the 1×6 sheathing boards were replaced with sheets of plywood. Basically, builders recognized that a single sheet of plywood could replace 16-1×6's and required half the amount of nails to provide at least the same level of strength and rigidity. This has been verified by many tests proving sheathed vertical diaphragms, also known as shear walls in light framed construction, can absorb a great deal of energy before failure making them very ductile and reliable. Plywood and its derivatives, such as oriented strand board, are still employed today as the best means for bracing homes in terms of both time and money savings but are nonetheless a combustible element not well suited as a substrate for many wall finishes.

Interior finishes for these new light framed structures consisted of plaster on lath until the first drywall panels were developed in the late 1910's by the United States Gypsum Company. However, it wasn't until the end of the Second World War, around the 1940's, that gypsum wallboard held an established place in the market as the best means for finishing walls. Today these panels have been refined and reformulated to be lighter and more fire resistant than their predecessors. In fact, they are recognized by modem building codes as the preferred cladding material for making light framed structures resistant to fire damage. Gypsum wallboard's effectiveness as a fire resistive barrier is due largely to its water content. When exposed to fire, these panels slowly release their water content in the form of steam, a process referred to as calcination, thereby retarding heat transmission to the underlying framing. After calcination is complete these panels continue to act as a barrier protecting the underlying framing from direct exposure to flames. These gypsum-based panels, however, lack the necessary in-plane shear strength, rigidity and ductility to adequately brace light frames structures against wind and earthquake forces. In some areas of the United States, where earthquakes are severe, their use as a shear wall sheathing element is strictly prohibited by the building code. This is due largely to the brittle, low strength nature of these panels. As a result, it has become a convention in modem construction to brace light frames structures by attaching a layer of plywood sheathing to the wall framework first. Then a layer of gypsum wallboard panels is attached over the plywood to finish the walls and protect the underlying framing and plywood from fire damage.

For the most part, thermal insulation for the exterior walls of these light framed structures consisted of a layer of building paper between the 1×6 sheathing and exterior siding until the 1930's. It was then that concerns over the cost of energy bills emerged and various insulation products such as mineral wool and eelgrass in paper quilts were developed to reduce coal bills. Today conventional insulation in light framed structures mostly involves filling the cavity between the wall studs with mass consisting of fiberglass, cellulose, or rock wool which slows heat flow resulting from conduction and convection. Disadvantageously, these mass insulation systems have little effect on heat flow resulting from radiation, more specifically, infrared radiation. It is well known that conduction, convection, and (infrared) radiation comprise the three modes in which heat transfer takes place. It is further well known that the addition of a reflective insulation system could prevent up to 65% of heat loss through walls during winter and 85% of heat gain during summer but are seldom installed in modem construction because of the added time and cost. In general, these reflective insulation systems consist of at least one layer of a low-emissivity material, such as aluminum foil, adjacent to an air space. It is also well known that these aluminum foils are typically between 0.00025 inches and 0.0004 inches thick. They're kept especially thin to save money but also because they're not intended to be used as a structural element. With rising concerns over high energy costs, as well as, the consumption of fossil fuels and the "greenhouse" gases they produce, insulating homes effectively to reduce the energy needed for their heating and cooling systems is both economically and ecologically essential.

Today, where affordable housing is in great demand, novel approaches are still needed that continue to simplify construction thereby saving time and money. This can be a daunting challenge given the increased performance expectations imposed on buildings by modem building codes. In addition, solutions are needed that also address energy efficiency over the life of the structure as well as the immediate cost savings sought during construction. After all, statistics show that between 50% and 70% of the energy used in the average home in the United States and Canada is for heating and cooling. Excluding the present invention, no wallboard panel exists today that is readily handled and quickly attached to the framework of light framed structures for the purpose of bracing, finishing, fireproofing, and thermally insulating wall structures in a single sheathing procedure. Such a composite panel would simplify construction by eliminating the need for multiple sheathing procedures thereby saving time and money. And such multiple sheathing procedures are currently needed since gypsum wallboard lacks the strength and rigidity, and in some cases prohibited, to be used as a shear wall sheathing element for resisting in-plane shear loads from wind and earthquake forces. Additionally, the same composite panel would address the need for coupling a reflective insulation system with a conventional mass insulation system thereby addressing all three modes of heat transfer. The end result being added long-term cost savings from lower heating and cooling bills as well as conservation of fossil fuels and a reduction of the "greenhouse" gases produced.

The prior art which most closely resembles the present invention is U.S. Pat. No. 5,768,841 to Swartz et al. which discloses a steel sheet attached to a gypsum wallboard panel where the metal sheet resists in-plane shear loads imposed on the framing structure of the building due to exterior environmental conditions. Disadvantageously, steel is heavy and its density can add significant weight to a gypsum wallboard panel (e.g. the density of steel is three times greater than aluminum). A typical sheet of ⅝" gypsum wallboard covering a wall area of 32 square feet weighs about 90 pounds each (conventional panels are typically manufactured with rectangular extents of 4 feet by 8 feet). Adding the weight of a steel sheet, as disclosed in the aforementioned patent, would increase the weight of the composite panel by at least 20 pounds but by as much as 80 pounds. That means the combined weight of the steel sheet and gypsum wallboard panel would weigh between 110 and 170 pounds. Added worker fatigue and a change in the way panels are normally handled would probably occur as a result of the weight of these unwieldy steel sheet composite panels. The end result being a slower installation process adding labor time and cost to construction.

Further, it is believed that a sheet of aluminum, for example, whose strength is less than the steel sheet disclosed by Swartz et al. is capable of resisting shear loads imposed on the shear wall due environmental conditions such as wind and earthquakes. Further yet, it is believed that a sheet of aluminum whose strength is less than the steel sheet disclosed by Swartz et al. can yield in-plane shear load capacities and rigidities relatively close to the capacities and rigidities expected from plywood or oriented strand board if its thickness is within the range of 0.006 and 0.03 inches and it possesses a minimum tensile strength of 20,000 pounds per square inch. It's even doubtful that Swartz et al.'s invention could achieve in-plane shear load capacities significantly greater than those expected from plywood sheathed shear walls. The surprising reason for this has to due with the fasteners used to attach the plywood panels to the framework, and not the plywood panels themselves. Shear walls, in modem light framed structures, are a complex assembly comprised of wall framework such as wall studs, sheathing panels such as plywood, and fasteners such as nails or screws. Tests on these shear wall assemblies have shown that the fasteners tend to pry loose from the underlying framework before the plywood panels rupture. Therefore, it is not advantageous to use a metal sheet whose in-plane strength and rigidity are greater than that of a sheet of plywood.

Another consideration regarding the use of steel sheets in a composite panel application would be the corrosive nature of steel. Left unprotected, steel will rust which lowers its' structural integrity. To protect steel against the harmful effects of rusting it is usually dipped in a zinc-based coating to shield it from the oxygen and moisture in our atmosphere. Steel can also be made corrosion resistant by alloying it with other metals like chromium and nickel. Although either method can adequately protect steel from corrosion, they disadvantageously add significant cost to the price of using steel.

Yet another disadvantage regarding the use of steel sheets in a composite panel application would be the high-emissivity properties of steel. Steel, like most building materials, tends to readily absorb and emit radiant heat. Radiant heat, commonly referred to as infrared radiation, can be defined as a band of electromagnetic waves in the wavelength range of 4 to 40 microns. These electromagnetic waves are constantly passing through the air, traveling in a straight line between the surfaces of wanner objects they're emitted from while heating the surfaces of the cooler objects they strike. All objects both absorb and emit infrared radiation, however, some absorb and emit substantially less due to their unique emissivity properties and surface characteristics. For example, materials said to have an emissivity factor of no greater than 20% would be said to have low-emissivity properties. To elaborate, these low-emissivity materials would neither absorb nor emit more than 20% of their heat through radiation. Reflective insulation systems, as mentioned previously, require at least one layer of a low-emissivity material, such as aluminum foil, to substantially impede radiant heat transfer. Remembering that light framed structures tend to lack a means of addressing heat transfer due to radiation, steel would not offer a solution to this insulation shortcoming. Aluminum foil, on the other hand, is well known to offer a solution to this insulation shortcoming but lacks the necessary strength and rigidity to reinforce a gypsum wallboard panel for resisting in-plane wind and earthquake loads adequately because it's too thin. According to the "Aluminum Standards and Data" handbook published by the Aluminum Association. "Foil-" is defined as "a rolled product that is rectangular in cross section of thickness less than 0.006 inch." However, it's well known that aluminum foils used for this application are typically between 0.00025 inches and 0.0004 inches thick which is more then ten times thinner than the aluminum sheet needed to provide the necessary in-plane shear strength and rigidity for resisting wind and earthquake loads adequately.

OBJECTS AND ADVANTAGES

Accordingly, it is an object of the present invention to provide a multipurpose wallboard panel that is easy to handle and installs quickly.

It is also an object of the invention to provide a multipurpose wallboard panel that simplifies the sequence of steps in construction thereby greatly reducing labor time and costs.

It is a further object of the invention to provide a multipurpose wallboard panel that is made from materials resistant to rusting and corrosion thereby extending the life of the panel while insuring the panels' structural integrity.

It is also an object of the invention to provide a multipurpose wallboard panel capable of greatly reducing radiant heat transfer in buildings thereby increasing energy conservation and decreasing energy costs for buildings.

It is still further an object the invention to provide a multipurpose wallboard panel that has sufficient strength and rigidity to adequately resist in-plane shear loads resulting from wind and earthquake forces thereby eliminating the need for plywood shear wall sheathing.

SUMMARY OF INVENTION

In accordance with the present invention a multipurpose composite wallboard panel comprises a wallboard panel and a thin sheet of aluminum attached thereto by an adhesive material. Such a wallboard panel can readily be handled and quickly attached to the framework of a building for the purpose of bracing, finishing, fireproofing, and thermally insulating the wall structure in a single wall sheathing procedure.

DRAWING FIGURES

REFERENCE NUMERALS IN DRAWINGS

Figure 1:
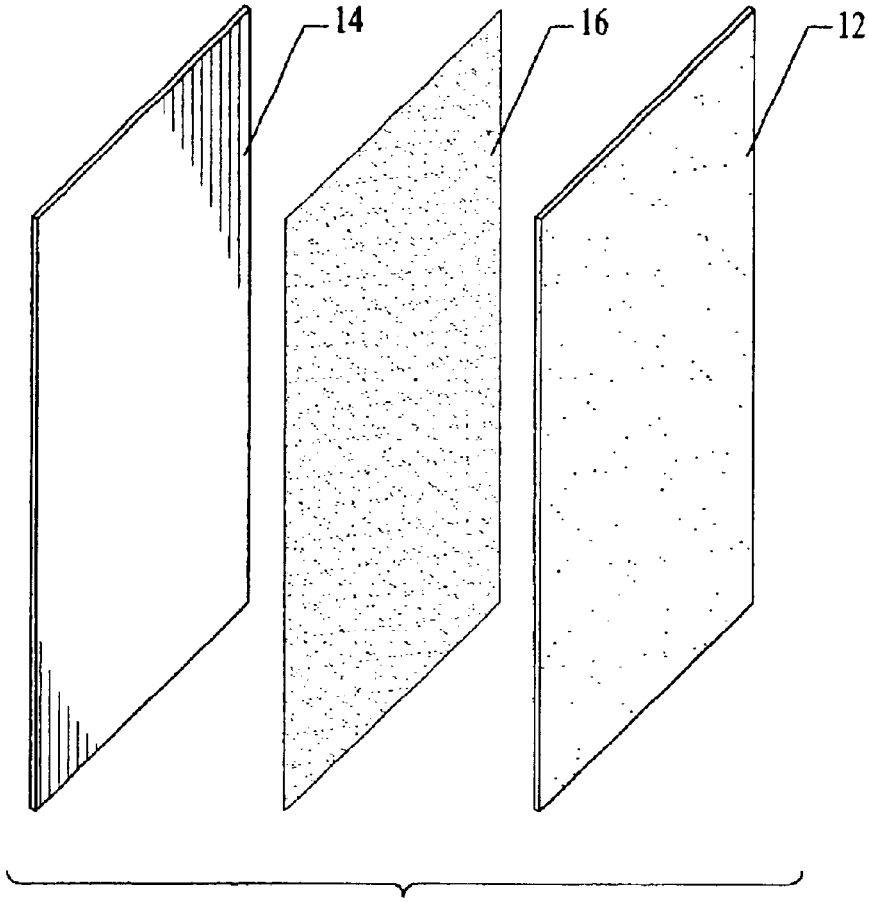
FIG. 1 shows an isometric view of the elements of a multipurpose composite wallboard panel of the present invention prior to assembly.

10 multipurpose composite wallboard panel (or composite panels, for short)
12 wallboard panel (forming part of a composite panel)
12' conventional wallboard panel (not forming part of a composite panel)
14 aluminum sheet
16 adhesive
20 wall studs (forming a part of the wall framework)
22 fasteners
24 mass insulation
26 air space
28 joint compound
40 joint sealing tape
42 exterior cladding or finish

DETAILED DESCRIPTION

DESCRIPTION—FIG. 1 AND FIG. 2—PREFERRED EMBODIMENT

Figure 2:
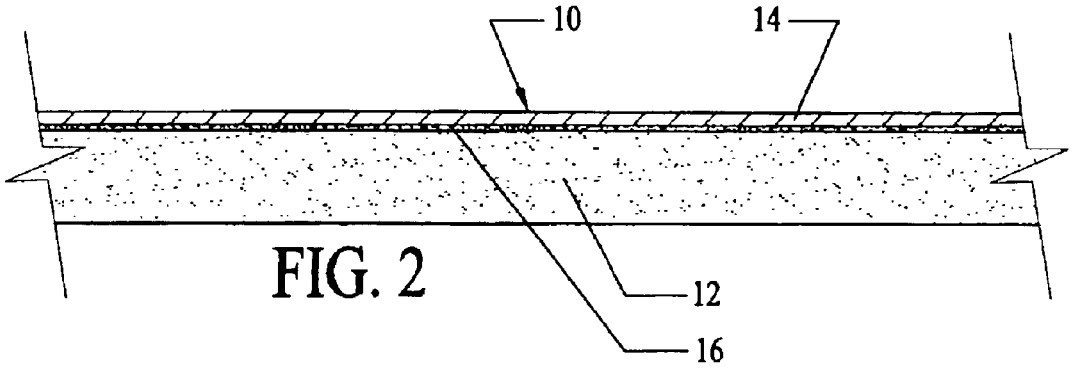
FIG. 2 shows a partially broken away cross-sectional view of the assembled multipurpose composite wallboard panel of FIG. 1, made in accordance with the principals of the invention.

A preferred embodiment of the multipurpose composite wallboard panel of the present invention is illustrated in FIG. 1 (unassembled isometric view) and FIG. 2 (assembled partially broken away cross sectional view) which comprises a wallboard panel 12 and an aluminum sheet 14 bonded together with an adhesive 16 disposed between them. Wallboard panel 12 may be any wallboard product whose center or core material contains gypsum, which may be currently available or developed in the future, and is used to cover wall studs in residential or commercial buildings. Typical wallboard panels may be gypsum wallboard, cement board panels, fiber reinforced panels, or other such wallboard panels used as a substrate for wall finishes (e.g. paint, wallpaper, stucco, etc.). Wallboard panel 12, such as illustrated in FIG. 1, may have paper (usually recycled paper) or fiberglass mesh disposed over the center or core material, which core material has excellent fire resistant properties but is generally considered brittle and low in strength.

Wallboard panel 12 is generally manufactured in a rectangular shape of 4 feet wide by 8 feet long, but can be smaller or larger in extents. Wallboard panel 12 is typically manufactured in a thickness range between ½ inch and ⅝ inch, but can be thinner or thicker. Aluminum sheet 14 is selected to have overall extents similar to that of the wallboard panel 12 to which it will be mated. The thickness of aluminum sheet 14 may be in the range of 0.006 and 0.03 inches but can be thicker. Aluminum sheet 14 should possess a minimum tensile strength of 20,000 pounds per square inch since a lower tensile strength would result in a substantially thicker sheet. Furthermore, while the preferred embodiment has been directed to an aluminum sheet, other metal sheets may be used if they are similar to aluminum or alloyed with aluminum.

Aluminum sheet 14 is preferably at least temporarily affixed to wallboard panel 12 by an adhesive 16 applied to one of the mating surfaces. The adhesive 16 may be epoxy or glue, and may be applied by various means such as brushing or spraying, for example. Adhesive 16 is preferably spread over the entire extents of one of the major surfaces of either wallboard panel 12 or aluminum sheet 14. Adhesive 16 is preferably a water-soluble latex based glue appropriate for use in residential or commercial building construction. Further, adhesive 16 should provide an adequate bond between wallboard panel 12 and aluminum sheet 14 allowing the entire multipurpose composite wallboard panel 10 to be shipped, handled, and attached to wall studs 20 under typical construction processes without separating. Additionally, adhesive 16 should possess an adequate bond strength allowing for typical panel modifications without separating (e.g. modifications such as saw cutting panels to sheath smaller wall areas or drilling holes within the panels for outlets or other fixtures).

A multipurpose composite wallboard panel 10 could be made employing automated processes. For example, wallboard panel 12 could be manufactured by automated machinery well known in the industry. Wallboard panel 12 could then be shipped to a laminating facility employing a laminating machine, also well known in the industry, to laminate the wallboard panel 12 to the aluminum sheet 14. To illustrate, the aluminum sheet 14 may be positioned above the wallboard panels 12, in coil form, with a width similar to the panels' width. As the laminating machine pulls the wallboard panels and aluminum sheet together along a conveyer, an adhesive 16 is disposed between them. Next, the wallboard panel 12 and aluminum sheet 14 are pressed together for a short time allowing them to bond together as they move along the conveyer. Once an appropriate bond is achieved between the two materials, the aluminum sheet is cut from the coil to a length similar to that of the wallboard panel 12. The resulting multipurpose composite wallboard panels 10 may then be hand stacked onto a pallet for shipping to the construction site or to a staging warehouse for temporary storage.

Advantages

From the description above, it's apparent that the present multipurpose composite wallboard panel has the distinct advantage of being easily handled and quickly installed to the framework of a building for the purpose of bracing, finishing, fireproofing, and thermally insulating the wall structures in a single sheathing procedure. Its further apparent that the aluminum sheet forming part of the composite panel has the following advantages:

- Aluminum has a density ⅓ that of steel which makes for a significantly lighter composite panel thereby promoting less worker fatigue and faster installation
- Aluminum is highly resistant to rusting and corrosion thereby extending the life of the composite panel while insuring the panels' structural integrity.
- Aluminum is very resistant to radiant heat transfer when positioned adjacent to an air space thereby addressing radiant heat transfer in buildings, a mode of heat transfer often neglected in modern building construction.

The sheet thickness specified has sufficient strength and rigidity to adequately resist in-plane shear loads resulting from wind and earthquake forces thereby eliminating the need for plywood shear wall sheathing.

Operation—FIGS. 3A to 3H

FIGS. 3A to 3H illustrate a multipurpose composite wallboard panel 10 attached to wall studs 20 of a typical light framed building structure. The multipurpose composite wallboard panel 10 may be attached to wall studs 20 by fasteners 22 comprising either nails or screws. In addition to fasteners 22, an adhesive may be disposed between the panels' aluminum face and wall studs 20 prior to panel attachment where increased shear wall performance is desired. Once the composite panel 10 is attached to the light framed building structure, such as wall studs 20, aluminum sheet 14 will assist the building framework in resisting in-plane or shear loads that are exerted on the building structure resulting from environmental conditions such as wind and earthquakes.

Figure 3A:
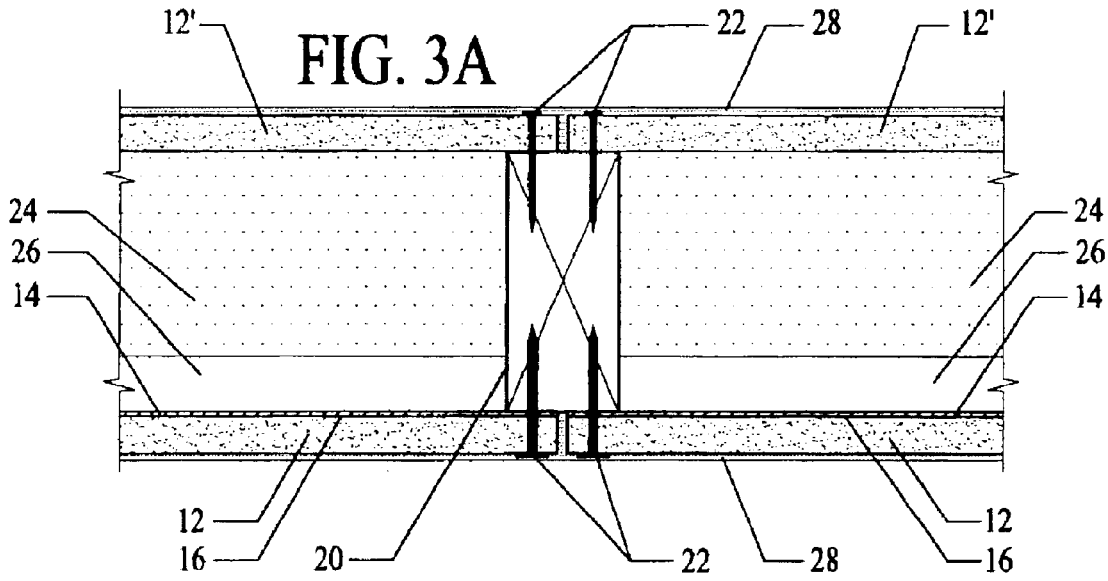
FIGS. 3A to 3C show partial cross-sectional views of a stud wall employing a multipurpose composite wallboard panel on one face of the wall and a conventional wallboard panel attached to the opposite face.
Figure 3B:
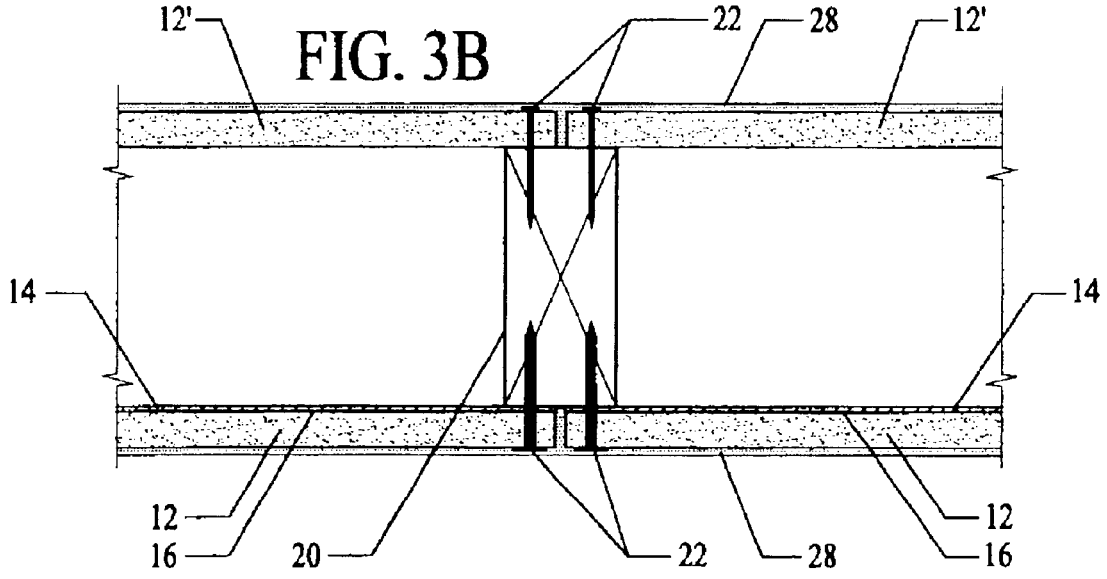
Figure 3C:
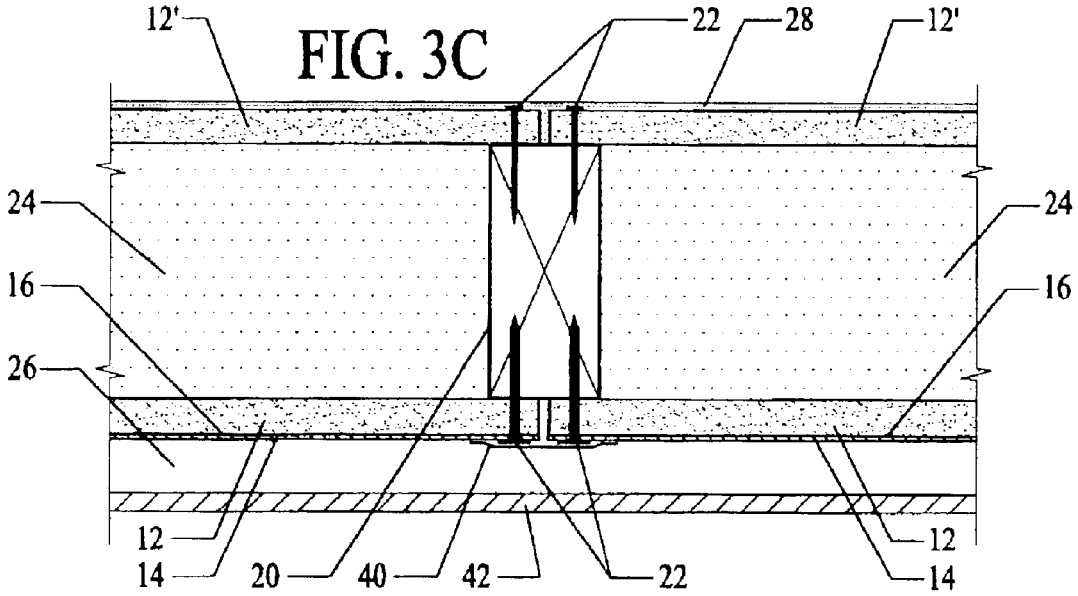
Figure 3D:
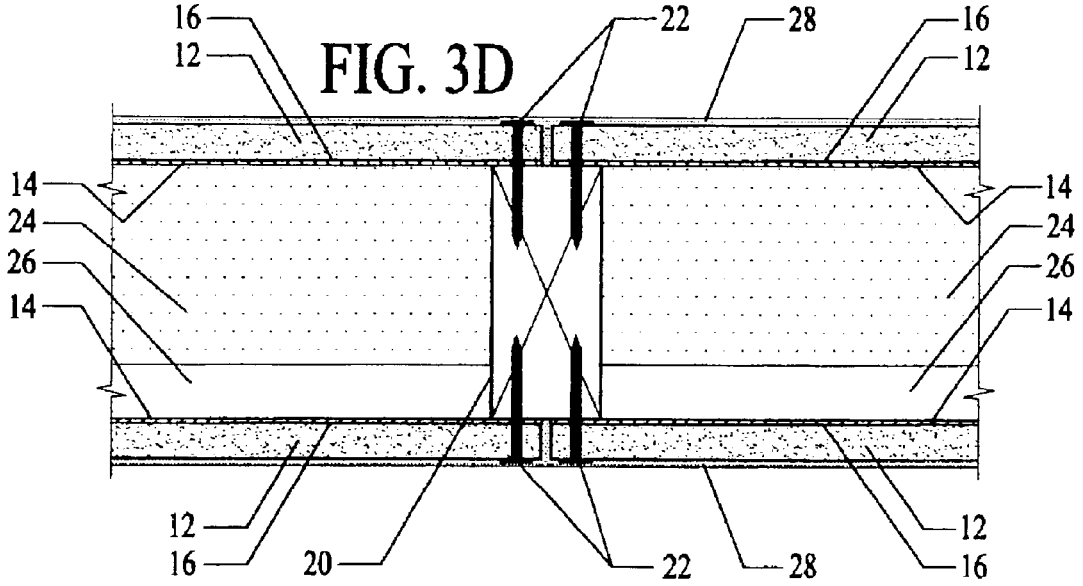
FIGS. 3D to 3F shows partial cross-sectional views of a stud wall employing a multipurpose composite wallboard panel on both faces of the wall (i.e. double sheathing application).
Figure 3E:
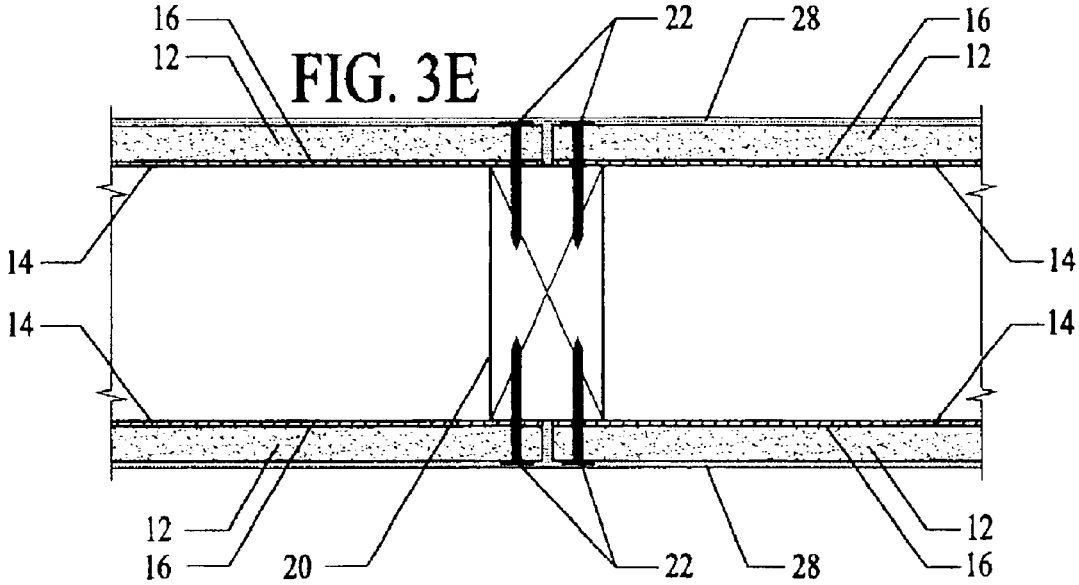
Figure 3F:
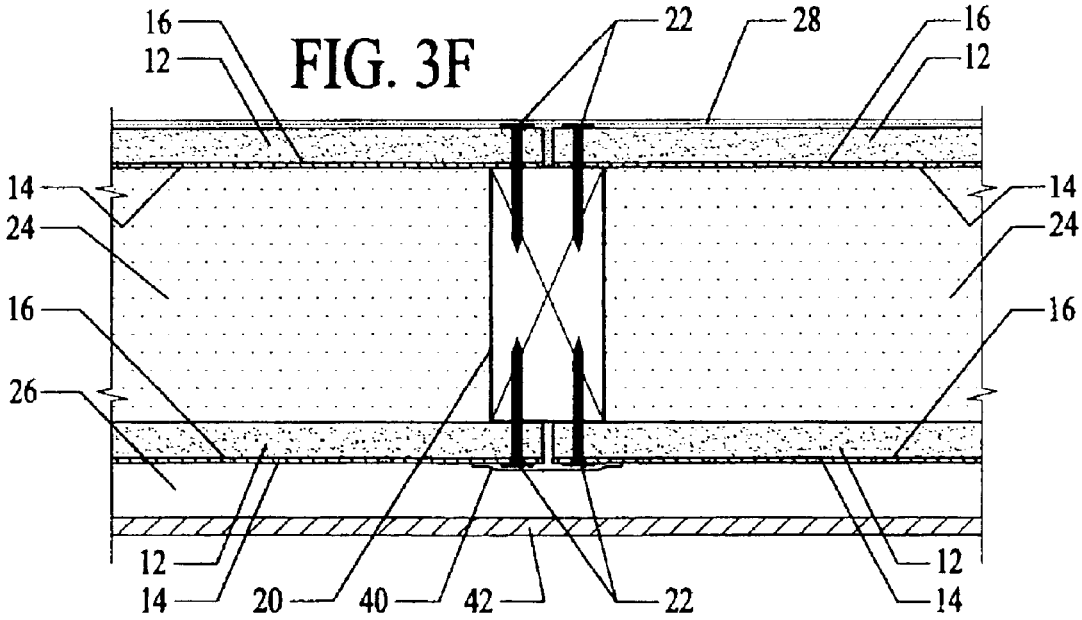

Typical examples of a multipurpose composite wallboard panel 10 employed in an exterior wall application are illustrated in FIGS. 3A, 3C, 3D, and 3F. FIGS. 3A and 3C illustrate a shear wall requiring composite panel sheathing on one face only whereas FIGS. 3D and 3F illustrate a shear wall requiring composite panel sheathing on both faces due to higher in-plane or shear loads exerted on the wall framework.

Figure 3G:
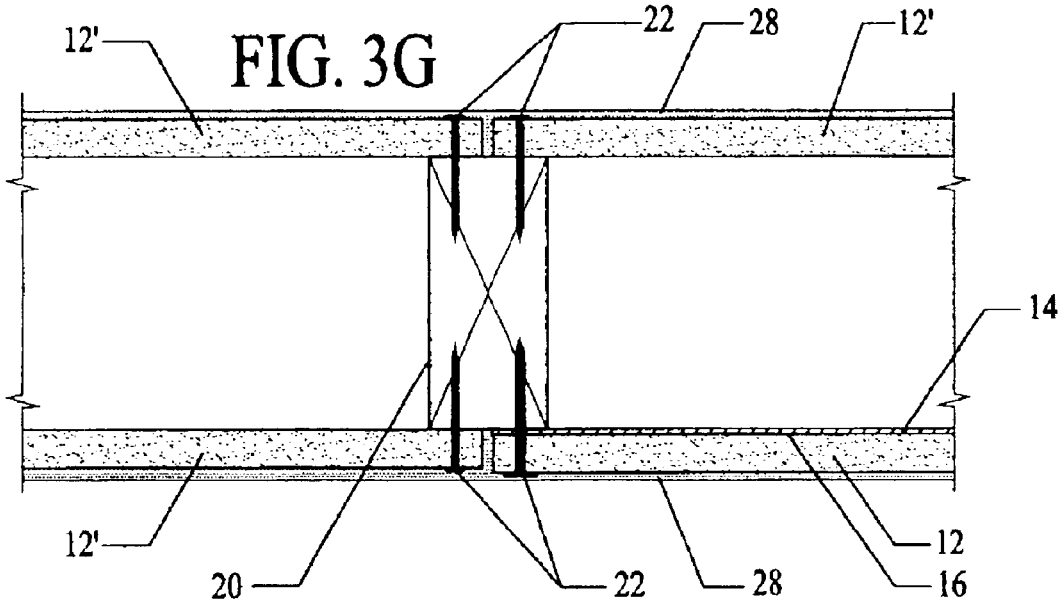
FIGS. 3G and 3H show partial cross-sectional views of a stud wall employing a multipurpose composite wallboard panel directly adjacent to a conventional wallboard panel on one or both faces of the wall.
Figure 3H:
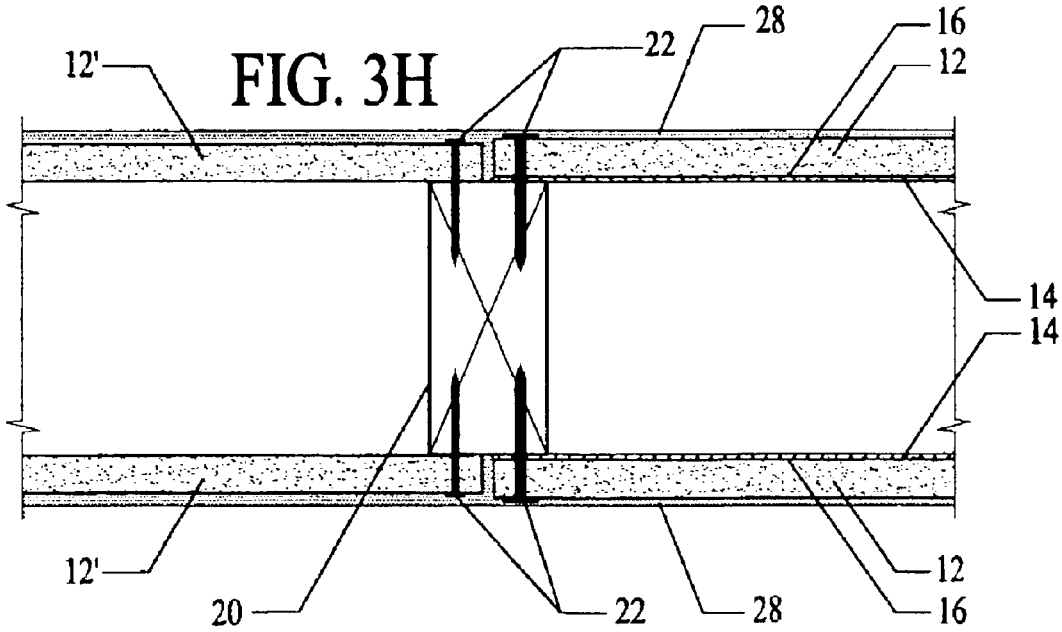

Typical examples of a multipurpose composite wallboard panel 10 employed in an interior wall application are illustrated in FIGS. 3B, 3E, 3G, and 3H. FIGS. 3B and 3G illustrate a shear wall requiring composite panel sheathing on one face only whereas FIGS. 3E and 3H illustrate a shear wall requiring composite panel sheathing on both faces due to higher in-plane or shear loads exerted on the wall framework. Note FIGS. 3G and 3H illustrate a conventional wallboard panel 12' attached directly adjacent to a composite panel 10. This can be advantageous, with respect to cost savings, where composite panels 10 are not employed as radiant heat insulators, such as in an interior wall application, and where composite panels 10 can adequately resist shear loads exerted on the wall framework when sheathing only a portion of the wall framework.

As shown in FIGS. 3A and 3D, when insulation against all three modes of heat transfer are sought, such as in an exterior wall application, the aluminum sheet 14 of the composite panel 10 is positioned adjacent to an air space 26 between the wall studs 20. The aluminum sheet 14 and air space 26 together form a reflective insulation system capable of greatly diminishing radiant heat transfer in buildings. Conventional mass insulation 24, on the other hand, is responsible for greatly diminishing conductive and convective heat transfer. Air space 26 may be formed between aluminum sheet 14 and mass insulation 24 by adding intermittent horizontal furring strips to the wall framework. These furring strips should be spaced as far apart as possible while still keeping mass insulation 24 from coming in direct contact with aluminum sheet 14. For instance, a typical spacing may be within the range of 2 feet to 4 feet. The depth of air space 26 may in the range of ¾ to 1 inch, but may be thinner or thicker as deemed appropriate by the architect or engineer.

FIGS. 3C and 3F illustrates another exterior wall application where insulation against all three modes of heat transfer are sought. The aluminum sheet 14 of composite panel 10, however, is facing outward instead of sitting directly against wall studs 20. The reason for this has to do with varying construction practices within the United States. For example, in some areas of the United States, such as Florida or North Carolina, it is convention to have the reflective surface of reflective insulation systems facing outward. By orienting composite panel 10 in this way it may be employed in a manner consistent with these local construction practices. The buildings exterior finish 42 is generally kept from coming in direct contact with aluminum sheet 14, such as by furring strips for example, thereby creating the air space 26 needed to create a reflective insulation system. Mass insulation 24 may fill the entire extents of the cavity between wall studs 20 as an air space in this cavity is not required.

Typically, joints between adjacent wallboard panels 12 and 12' as well as depressions made within the wallboard panels by fasteners 22 will be covered with an application of joint compound 28. After joint compound 28 has cured, it may be sanded rough for repeated application of joint compound 28. The final application of joint compound 28 is usually sanded smooth allowing for the final wall finish to be applied (for example: paint, wallpaper, stucco, etc.).

Where aluminum sheet 14 of composite panel 10 is facing outward, as shown in FIGS. 3C and 3F, all joints between adjacent aluminum sheets will be covered with a joint sealing tape 40, such as aluminum foil tape, to prevent radiant heat transfer from occurring at these discontinuous areas.

Conclusion, Ramifications, and Scope

Accordingly, the reader will see that the multipurpose composite wallboard panel of this invention can readily be handled and quickly attached to the framework of a building for the purpose of bracing, finishing, fireproofing, and thermally insulating the wall structures in a single sheathing procedure. Furthermore, the aluminum sheet forming part of the composite panel has the following advantages in that:

- Aluminum has a density ⅓ that of steel which makes for a significantly lighter composite panel thereby promoting less worker fatigue and faster installation, reducing labor time and cost.
- Aluminum is highly resistant to rusting and corrosion thereby extending the life of the composite panel while insuring the panels' structural integrity.
- Aluminum is very resistant to radiant heat transfer when positioned adjacent to an air space thereby addressing radiant heat transfer in buildings, a mode of heat transfer often neglected in modern building construction.

The sheet thickness specified has sufficient strength and rigidity to adequately resist in-plane shear loads resulting from wind and earthquake forces thereby eliminating the need for plywood shear wall sheathing.

Although the description above contains many specifics, these should not be construed as limiting the scope of the invention but merely providing illustrations of some of the presently preferred embodiments of this invention. It should be understood that various changes and modifications obvious to one skilled in the art to which the invention pertains are deemed to lie within the spirit and scope of the invention as set forth in the following claims.

I claim:

1. A building shear wall structure for accommodating in-plane or shear loads imposed on the wall structure comprising:

a plurality of framing studs forming part of the building;

a plurality of multipurpose composite wallboard panels, each multipurpose composite wallboard panel comprising only one wallboard panel and one thin sheet of high strength material attached to and covering one entire side of the wallboard panel, the wallboard panel and attached thin sheet of high strength material forming together the entire multipurpose composite wallboard panel; and securing means for attaching the multipurpose composite wallboard panels to the framing studs such that the thin sheet of high strength material sits directly against the framing studs, the thin sheet of high strength material having properties at least as great as an aluminum sheet having a thickness within the range of 0.006 and 0.03 inches and having a tensile strength of at least 20000 pounds per square inch, the thin sheet of high strength material being capable of resisting anticipated in-plane or shear loads imposed on the shear wall structure due to environmental conditions such as wind and earthquakes.

2. The multipurpose composite wallboard panel of claim 1 wherein the thin sheet of high strength material is a metal.

3. The multipurpose composite wallboard panel of claim 2 wherein the metal sheet has a low emissivity.

4. The multipurpose composite wallboard panel of claim 3 wherein the emissivity is no greater than 0.20.

5. The multipurpose composite wallboard panel of claim 3 wherein the low emissivity metal sheet is adjacent to an air cavity.

6. The multipurpose composite wallboard panel of claim 3 wherein the low emissivity metal sheet is aluminum.

7. The multipurpose composite wallboard panel of claim 6 wherein the aluminum sheet has a thickness within the range of 0.006 and 0.03 inches.

8. The multipurpose composite wallboard panel of claim 1 wherein the wallboard panel is a sheet of gypsum.

9. The shear wall structure of claim 1 wherein the securing means comprises screws.

10. The shear wall structure of claim 1 wherein the securing means comprises nails.

11. A building shear wall structure for accommodating in-plane or shear loads imposed on the wall structure comprising:

a plurality of framing studs forming part of the building;

a plurality of multipurpose composite wallboard panels, each multipurpose composite wallboard panel comprising only one gypsum type wallboard panel and one thin aluminum sheet having a thickness within the range of 0.006 and 0.03 inches and having a tensile strength of at least 20000 pounds per square inch, attached to and covering one entire side of the wallboard panel, the wallboard panel and attached aluminum sheet forming together the entire multipurpose composite wallboard panel; and a plurality of fasteners extending through the multipurpose composite wallboard panels and into the framing studs so that the aluminum sheets sit flush against the framing studs, each aluminum sheet being capable of resisting in-plane or shear loads anticipated to be imposed on the shear wall due to wind and earthquakes.

12. The shear wall structure of claim 11 wherein the fasteners are screws.

13. The shear wall structure of claim 11 wherein the fasteners are nails.

14. A building shear wall structure for accommodating in-plane or shear loads imposed on the wall structure comprising:

a plurality of framing studs forming part of the building;

a plurality of multipurpose composite wallboard panels, each multipurpose composite wallboard panel comprising only one gypsum type wallboard panel and one thin aluminum sheet having a thickness within the range of 0.006 and 0.03 inches and having a tensile strength of at least 20000 pounds per square inch, attached to and covering one entire side of the wallboard panel, the wallboard panel and attached aluminum sheet forming together the entire multipurpose composite wallboard panel; and a plurality of fasteners extending through the multipurpose composite wallboard panels and into the framing studs so that the gypsum type wallboard panels sit flush against the framing studs, each aluminum sheet being capable of resisting in-plane or shear loads anticipated to be imposed on the shear wall due to wind and earthquakes.

15. The shear wall structure of claim 14 wherein the fasteners are screws.

16. The shear wall structure of claim 14 wherein the fasteners are nails.

* * * * *